United States Patent [19]

Takeda et al.

[11] 3,959,528

[45] May 25, 1976

[54] COATING METHOD

[75] Inventors: Hideo Takeda; Nobuhiko Oyama, both of Minami-ashigara, Japan

[73] Assignee: Fuji Photo Film Co., Ltd., Minami-ashigara, Japan

[22] Filed: Dec. 19, 1974

[21] Appl. No.: 534,392

[30] Foreign Application Priority Data

Dec. 19, 1973 Japan ..... 48-143289

[52] U.S. Cl. ..... 427/290; 96/87 R; 96/85; 427/129; 427/207; 427/150; 118/72

[51] Int. Cl.[2] ..... B44D 5/02

[58] Field of Search ..... 427/290, 428, 324, 129, 427/207; 118/72; 96/67, 87 R, 85

[56] References Cited

UNITED STATES PATENTS 3,853,585 10/1974 Tatsuta et al. ..... 96/87 R X 3,867,167 2/1975 Tatsuta et al. ..... 96/87 R X

*Primary Examiner*—Ralph S. Kendall

*Attorney, Agent, or Firm*—Sughrue, Rothwell, Mion, Zinn & Macpeak

[57] ABSTRACT

A method of coating liquid coating compositions on a moving continuous web comprising roughening only the surface of a portion of the smooth web surface onto which coating is started. The method of this invention avoids the production of a thick coating to thereby prevent contamination in the steps and the process and requires no excess increase in drying, and the method is especially advantageous in the manufacture of photographic films, photographic papers, magnetic recording tapes, adhesive tapes, pressure sensitive recording papers, offset printing papers, etc.

3 Claims, 3 Drawing Figures

COATING METHOD

BACKGROUND OF THE INVENTION

1. Field of the Invention

This invention relates to a method of coating liquid coating compositions of various kinds in which one or more layers of liquid coating composition are applied to a moving support which is in the form of continuous web (hereinafter referred to as "web") in the manufacture of, e.g., photographic films, photographic papers, magnetic recording tapes, adhesive tapes, pressure sensitive recording papers, offset printing papers, etc. More particularly, the invention relates to a method of preventing a thick coating of a liquid coating composition encountered at the time of starting the coating.

2. Description of the Prior Art

In conventional methods in which the coating of a liquid coating composition of various kinds on a web is started, as shown in FIG. 1, even if the liquid coating composition 2 should come into; contact with the web 1 moving in the direction as indicated by the arrow A, generally the liquid coating composition 2 would not immediately be coated on the web 1, but it will be coated on the web 1 after the passage of a section (*l*) of the web between where coating is started and where the coating composition actually is laid on the web. In this instance, it has been known that the coated film in the vicinity of a line (hereinafter referred to as "coating start line") 3 formed by joining points wherein the liquid coating composition 2 is initially applied to the web 1 has a coating thickness ranging from about 5 to 100% above that of other portions of the web. This coating start line does not always appear in the form as illustrated in FIGS. 1 (*a*), (*b*) and (*c*), but may often assume complicated shapes. A number of studies has been made on various aspects to find the cause of this difficulty at the time of starting the coating, but an established theory has not yet been found and clarified. Although an explanation has often been offered that the liquid coating composition 2 does not adhere to the web 1 until the web 1 is sufficiently wetted, such an explanation may not have be persuasive as a result of observing the phenomenon in all its aspects. Under the present conditions, means of minimizing such a difficulty encountered at the time of starting the coating do not exist since the cause of the difficulty is not clear. Unless such a difficulty encountered at the time of starting the coating is eliminated, a period of time for the drying process for drying the thickly coated film in the vicinity of the coating start line should be prolonged notwithstanding the fact that the thickly coated portion is only a portion of the entire area. In addition, if the thickly coated portion is not sufficiently dried, a part of the undried coated film remains on a reversing roller or the like after the drying step has been completed, resulting in contamination in the steps, thereafter a disturbance of the surface of the coated film, and a marked loss of value in the product. Thus, this difficulty poses a significant problem.

SUMMARY OF THE INVENTION

It is therefore an object of this invention to remove such a difficulty encountered at the time of starting the coating as noted above, to prevent the thick coating of a coating film in the vicinity of the coating start line, and to prevent an excess increase in the drying load.

The above object of the present invention can be accomplished by roughening the smooth surface of the web only in an area to which the coating of the coating composition to be started prior to application of the coating composition.

The roughening of the surface as herein used includes forming depressions and projections generally referred to as "silk meshes" in the surface of the web, forming relatively great depressions and projections by knurling, and forming relatively small depressions and projections by abrasion, e.g., with fine sand-paper.

A preferred embodiment of the present invention will now be described with reference to the accompanying drawings in which:

DESCRIPTION OF A PREFERRED EMBODIMENT

Figure 1:
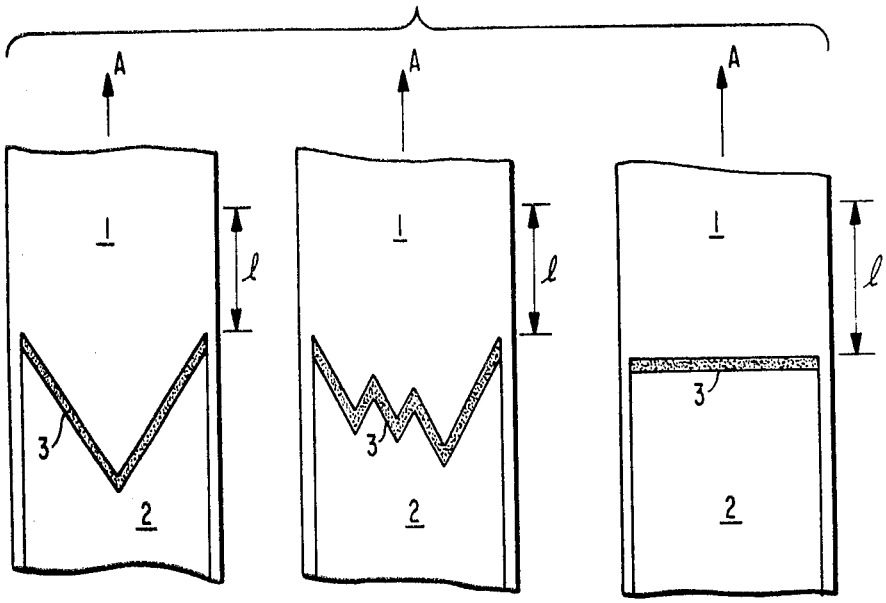
FIG. 1 illustrates modes of the coated web in a portion of the web where coating is initiated in accordance with conventional methods of coating.
Figure 2:
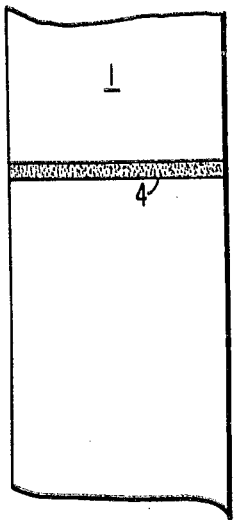
FIG. 2 illustrates a preferred embodiment of the present invention.

FIG. 2 shows a relatively smooth surfaced web web 1 processed in accordance with the present invention.

A rough surface in a rectangular area 4 formed by two straight lines substantially perpendicular to the travelling direction of the web 1 in the surface of the web corresponding to an area of the web to which the coating composition is applied is formed. These two straight lines need not be necessarily made substantially perpendicular to the travelling direction of the web 1, but such an arrangement would be the usual form. Also, the rough area 4 need not necessarily be rectangular in configuration. The width of the rough surface area 4 in the travelling direction of the web 1 differs with the type of liquid coating composition, the type of web, the quantity of coating to be applied, the speed of coating, and the like. Generally, however, the greater the width, the more accurate is the effect obtained. Thus, preferably, the roughened area is wide. In practice, it is most desirable that the width be experimentally determined. However, in most of cases, a portion of the web to be initially coated is a web portion, which is to be thrown away after coating is completed, but not a web portion serving as a product. From this reason, the width in question can be made greater more or less.

The formation of the rough surface can be effected by using a simple knurling tool or a press roller whose surface has depressions and projections, before the coating composition is applied to the rough surface area 4.

A conventional bead coating method was employed to apply a silver halide photographic emulsion to a web 1 whose surface has been roughened in a manner as described above, and as a result, the liquid coating composition was smoothly applied from the pretreated rough surface area 4 onto the web 1, which results in an elimination of the initial thick coating portion of a coated film heretofore encountered.

Figure 3:
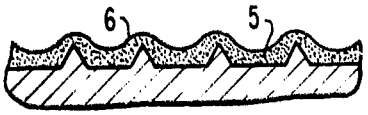
FIG. 3 illustrates an air boundary film formed in a roughened surface portion in accordance with the present invention.

Although the application of the pretreatment, by which the web surface is roughened leads to a prevention of the occurrence of the starting section (*l*) and the thick coating of a film in the vicinity of the coating start line, as described above, the reason for this is at present unknown and hence it is difficult to provide a definite theoretical explanation. According to a possible explanation, the following phenomena may be probably considered. That is, the moving web surface is usually accompanied by air forming an air film thereon. Therefore, when the coating liquid is merely applied, a layer of that coating liquid applied onto the web surface by means of an injector may slip and may not be applied to the web until a supply of the coating liquid possessing a sufficient weight to remove the air film is obtained, and thus when the coating liquid is applied to the web, the excessive coating liquid remains on the web surface thus applied, resulting in the formation of the thickly coated film. On the other hand, when the web is treated to form a rough surface as in the present invention, the air film 5 reduces in thickness in the vicinity of the top 6 of the projecting portion as seen in FIG. 3 to thereby produce a thinner and a thicker air film 5. As a consequence, the air film present in the top 6 of the rugged projecting portion may be readily removed by the layer of coating liquid supplied by the injector so as to avoid slipping of the coating liquid layer. thus with no starting section (*l*) occurring and with a thick coating of the coated film being prevented.

Since many apparently widely different embodiments of this invention can be made without departing from the scope thereof, it is to be understood that the invention is not limited to the specific embodiments thereof described herein. For example, the formation of the rough surface need not necessarily be accomplished by knurling but can be accomplished by abrasion, e.g., using sand-paper.

However, as can be imagined from the foregoing discussion, the formation of the rough surface desirably should result in the top of the rough projecting portions being as sharp as possible, and the rough depressed portions are preferably made as deep as possible as compared with the other portions, and hence a sand-paper well suited for the quality of the web should be selected. The roughness of the sand-paper used should be experimentally determined.

It can also to be understood that the present coating method can be applied not only to the bead coating method, but to extrusion coating methods and other types of coating methods.

The effect of the present invention will be better understood from the following example.

EXAMPLE

A rough surface on a film of cellulose triacetate having a thickness of 100 $\mu$ and a width of 250 mm across the entire surface of the web and for a length of 2.5 m in the travelling direction of the web was formed using a saw-tooth knurling tool. The knurling tool was first applied to the opposite side of the surface to be coated of the web, the space between the tops of the rugged projecting portions being 1 mm both in the web travelling direction and in the width direction, and the height to the top of the rough projecting portions being within the range 0.07 to 0.09 mm.

To the web thus treated to have a rough surface, the coating liquids shown in Table 1, that is, two layers of liquids comprising Liquid I for the lower layer and Liquid II for the upper layer were simultaneously applied.

TABLE 1

| | | |
|---|---|---|
| Liquid I | Gelatin Solution (5 wt%) | 1000 parts |
| | p-Styrene Sulfonic Acid (system viscosity increasing agent) | 10 parts |
| | Anionic Activator Including Sulfonic Acid Salts (system activator) | 1 part |
| | Viscosity | 35 cp |
| | Surface Tension | 32 dyne/cm |
| Liquid II | Gelatin Solution (10 wt%) | 1000 parts |
| | AgBr | 160 parts |
| | p-Styrene Sulfonic Acid (system viscosity increasing agent) | 5 parts |
| | Anionic Activator Including Sulfonic Acid Salts (system activator) | 2 parts |
| | Viscosity | 40 cp |
| | Surface Tension | 35 dyne/cm |

The amount of coating was 100 cc/m$^2$.

In this case, the coating speed, that is, the travelling speed of the web was varied from 20 m/min to 100 m/min, and even in the case of 100 m/min the coating was immediately started from the roughened surface area. In the case of a web speed of 100 m/min, actual measurement of the coating thickness in the vicinity of the coating start line indicated the level of the thick coating was 11 percent. The rate of the thick coating is given by $$\text{Thick Coating Rate (\%)} = \frac{\text{Film Thickness in the Vicinity of the Coating Start Line} - \text{Predetermined Film Thickness}}{\text{Predetermined Film Thickness}} \times 100$$

Then, a web the same as the above web but to which the treatment for forming the rough surface was not applied was coated under exactly the same conditions as to the coating liquid and the manner of coating.

The result was such that 2 to 3 cm guiding sections occurred at a speed of 40 m/min or so to show a severe thick coating, which reached a thick coating rate of 78 percent in the vicinity of the coating start line. Further, at a speed in excess of 60 m/min, the coating was impossible to start.

Thus, it has been demonstrated that with the usual web a thick coating rate up to 78 percent at a coating speed of 40 m/min occurs, while with the web to which the treatment to provide a rough surface was applied merely produces a thick coating rate only up to 11 percent even at a speed of 100 m/min.

Some new effects provided by the present invention are as follows.

1. Since the thick coating of the coated film in the vicinity of the coating start line can be prevented at the time of starting coating, the contamination caused by the adhesion of the undried coated film to reversing rolls can be avoided.

2. Since the thick coating of the coated film in the vicinity of the coating start line can be prevented at the time of starting coating, a drying step heretofore required to dry the aforesaid thickly coated portion can be omitted, or the same drying apparatus as that of the prior art can also be used to considerably increase the drying capacity.

While the invention has been described in detail and with reference to specific embodiments thereof, it will be apparent to one skilled in the art that various changes and modifications can be made therein without departing from the spirit and scope thereof.

What is claimed is:

1. In a method of coating a liquid composition onto a smooth surface of a travelling, continuous web comprising the step of applying a liquid coating composition to said smooth surface of said web, the improvement which comprises the step of pre-roughening the surface area only of the web where the coating is started prior to applying said liquid coating.

2. The method of claim 1, wherein said surface roughening step comprises forming adjacently, relatively deep depressions and relatively sharp projections in the surface of said web.

3. The method of claim 1, wherein said surface roughening step comprises roughening the web surface with a knurling tool, compressing said web surface with a press roller whose surface contains depressions and projections therein, or abrading said web surface.

* * * * *